US007281589B2

(12) United States Patent
Robichaux et al.

(10) Patent No.: US 7,281,589 B2
(45) Date of Patent: Oct. 16, 2007

(54) BALL DROPPING TOOL METHOD AND APPARATUS

(75) Inventors: Kip M. Robichaux, Houma, LA (US); Michael Legleux, Kenner, LA (US)

(73) Assignee: Mako Rentals, Inc., Houma, LA (US)

( * ) Notice: Subject to any disclaimer, the term of this patent is extended or adjusted under 35 U.S.C. 154(b) by 0 days.

(21) Appl. No.: 11/460,520

(22) Filed: Jul. 27, 2006

(65) Prior Publication Data

US 2007/0068679 A1 Mar. 29, 2007

Related U.S. Application Data

(60) Provisional application No. 60/805,688, filed on Jun. 23, 2006, provisional application No. 60/703,590, filed on Jul. 29, 2005.

(51) Int. Cl.
*E21B 33/03* (2006.01)
*E21B 23/00* (2006.01)

(52) U.S. Cl. ..... 166/386; 166/75.15; 166/193

(58) Field of Classification Search ..... 166/75.15, 166/193, 70, 381, 386
See application file for complete search history.

(56) References Cited

U.S. PATENT DOCUMENTS

| | | | | |
|---|---|---|---|---|
| 2,713,909 | A | 7/1955 | Baker | |
| 2,961,045 | A | 11/1960 | Stogner et al. | |
| 2,961,046 | A | 11/1960 | Moeller et al. | |
| 3,403,729 | A | 10/1968 | Hickey | |
| 3,616,850 | A | 11/1971 | Scott | |
| 4,317,486 | A | 3/1982 | Harris | |
| 4,427,065 | A | 1/1984 | Watson | |
| 4,491,177 | A * | 1/1985 | Baugh | 166/75.15 |
| 4,624,312 | A | 11/1986 | McMullin | |
| 4,671,353 | A | 6/1987 | Daming | |
| 4,722,389 | A | 2/1988 | Arnold | |
| RE33,150 | E * | 1/1990 | Boyd | 166/242.5 |
| 4,907,649 | A | 3/1990 | Bode | |
| 4,917,184 | A | 4/1990 | Freeman et al. | |
| 4,995,457 | A | 2/1991 | Baldridge | |
| 5,095,988 | A | 3/1992 | Bode | |
| 5,205,359 | A | 4/1993 | Stephenson | |
| 5,277,248 | A | 1/1994 | Breland | |
| 5,435,390 | A | 7/1995 | Baugh et al. | |
| 5,443,122 | A | 8/1995 | Brisco | |
| 5,494,107 | A | 2/1996 | Bode | |
| 5,722,491 | A | 3/1998 | Sullaway et al. | |
| 5,758,726 | A * | 6/1998 | Streich et al. | 166/379 |
| 5,829,523 | A | 11/1998 | North | |
| 5,833,002 | A | 11/1998 | Holcombe | |
| 5,890,537 | A | 4/1999 | Lavaure et al. | |
| 5,950,724 | A | 9/1999 | Giebeler | |
| 6,206,095 | B1 | 3/2001 | Baugh | |
| 6,302,199 | B1 * | 10/2001 | Hawkins et al. | 166/70 |

(Continued)

*Primary Examiner*—David Bagnell
*Assistant Examiner*—Shane Bomar
(74) *Attorney, Agent, or Firm*—Garvey, Smith, Nehrbass & North, L.L.C.; Brett A. North

(57) ABSTRACT

One embodiment includes a method and apparatus for an improved ball dropper. In one embodiment the method and apparatus can be used to drop various objects into the well bore from the rig. In one embodiment, when the well is pressurized the tool can be loaded with one or more items to be dropped.

36 Claims, 12 Drawing Sheets

U.S. PATENT DOCUMENTS 6,575,238 B1 6/2003 Yokley
2005/0039925 A1 2/2005 Connell
2007/0158078 A1* 7/2007 Boyd ..... 166/380

* cited by examiner

BALL DROPPING TOOL METHOD AND APPARATUS

CROSS-REFERENCE TO RELATED APPLICATIONS

U.S. Provisional Patent Application Ser. No. 60/805,688, filed on 23 Jun. 2006 is incorporated herein by reference.

Priority of U.S. Provisional Patent Application Ser. No. 60/805,688, filed on 23 Jun. 2006, is hereby claimed.

U.S. Provisional Patent Application Ser. No. 60/703,590, filed on 29 Jul. 2005 is incorporated herein by reference.

Priority of U.S. Provisional Patent Application Ser. No. 60/703,590, filed on 29 Jul. 2005, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND

This invention relates to tools for dropping balls into a tubing or casing string of a well bore.

In the course of operating downhole tools in an oil or gas well, it is sometimes necessary to release one or more variously sized balls or plugs from the surface into the tubing or casing string. The devices used for dropping balls or plugs are sometimes referred to as ball droppers, ball dropping heads, or cementing heads, plug containers or ball dropping heads.

A common method of releasing balls in these types of devices involves the use of linear actuators which are operated by either being rotated by a screw mechanism from the outside of the container or by a remote controlled piston on the outside of the container. The nature of these linear actuators is such that they protrude from the side of the container far enough to be cumbersome to use and are sometimes a problem on the rig floor. Because of the extension of the linear actuators, the operator may not be able to rotate the container because the distance between the bails is not sufficient to clear the actuators and allow them to rotate freely.

Additionally, prior art ball dropping tools must be preloaded, i.e., they cannot be loaded with balls when the tools are installed in a pressurized string of tubing or tubulars. Accordingly, where additional balls are required to be dropped while the tools are in the drill string, then, before loading the dropping tool, pressure must be relieved from the string of tubing or tubulars. Furthermore, in many cases prior art ball droppers must be removed from the line when being loaded with balls.

Various embodiments solve one or more of these problems by providing a compact mechanism for releasing balls or other items into the tubing or casing string even while the string pressurized. A tool is provided permitting easy release of one or more balls. Additionally, at least a portion of the ball loading section of can be fluidly sealed from the remainder of the tool.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

The apparatus of the present invention solves the problems confronted in the art in a simple and straightforward manner. In one embodiment a method and apparatus for an improved ball dropper is disclosed. In one embodiment the method and apparatus can be used to drop various objects into the well bore from the rig.

In one embodiment, when the well is pressurized the tool can be loaded with one or more items to be dropped.

In one embodiment, items to be dropped can be sequentially loaded into the tool. In one embodiment a smaller item is dropped first and then a larger item dropped thereafter.

In one embodiment, a side drop passage is contained in an enlarged area.

In one embodiment, items of different sizes and/or shapes are dropped.

In one embodiment, items of different sizes and/or shapes are sequentially dropped.

In one embodiment, a plurality of items are simultaneously dropped.

In one embodiment, a plurality of items of different sizes and/or shapes are simultaneously dropped.

In one embodiment, the tool is used to engage or disengage a downhole tool, such as a jet washing tool.

In one embodiment a method of dropping a ball into a well comprising the steps of positioning a ball drop apparatus above the well, the apparatus comprising a main body section having upper and lower portions; a main passage through the main body section from the upper portion to the lower portion; a side drop passage which intercepts the main passage; a seal operatively connected to the side drop passage, separating the side drop passage into upper and lower portions, and having open and closed states; and a cap operative sealing the upper portion of the side drop passage. The method further comprises the steps of opening the seal to allow an item to drop from the side passage to the main passage and down the well.

In one embodiment a pressure equalization control can be used to equalize the pressure above and below the seal operatively connected to the side drop passage. In one embodiment the equalizing control is controlled by a handle which rotates.

In one embodiment a vent control can be used to vent pressure either above and/or below the seal operatively connected to the side drop passage.

The step of positioning preferably comprises attaching the ball drop apparatus to a top drive unit and lowering the ball drop apparatus with the top drive unit toward the well.

In one embodiment the method includes the additional step of checking to determine whether the item dropped failed to activate a downhole tool and then dropping a second item to activate the downhole tool.

In one embodiment, a means of circulating fluids through the drill string prior to, and after release of, the balls, is provided.

In one embodiment multiple items can be dropped simultaneously from multiple locations in the method and apparatus.

In one embodiment a method and apparatus for use with top drive units is provided.

In one embodiment, the ball dropping tool can also improve conditions for the rig hands where it can be remotely controlled from the floor of the rig.

The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 2:
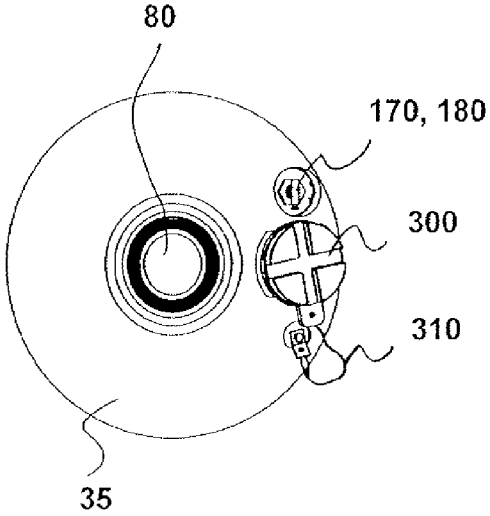
FIG. 2 is a top view of the tool of FIG. 1.
Figure 1:
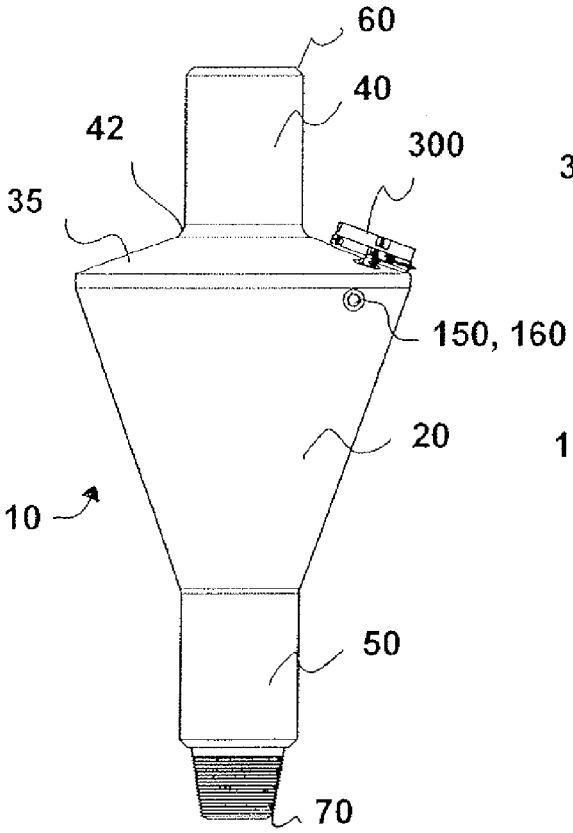
FIG. 1 is a front view of a preferred embodiment of the tool.
Figure 3:
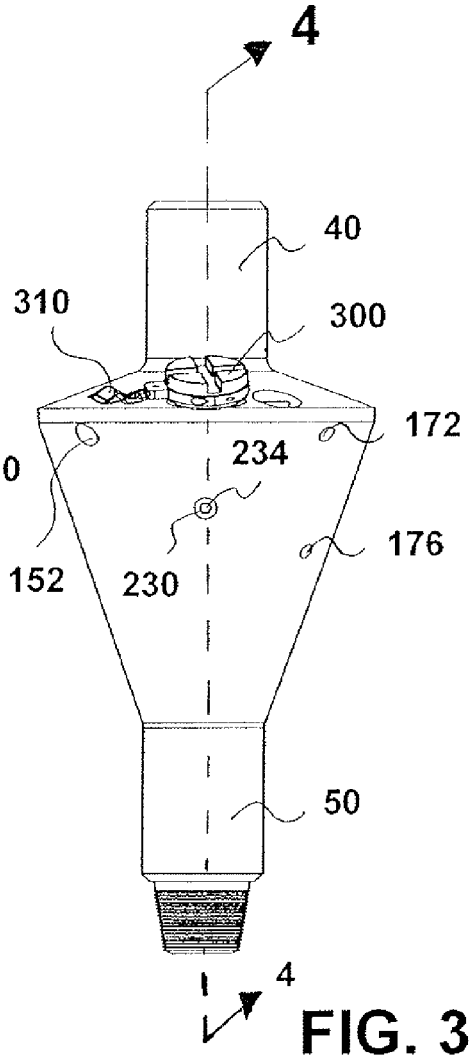
FIG. 3 is a side view of the tool of FIG. 1.
Figure 4A:
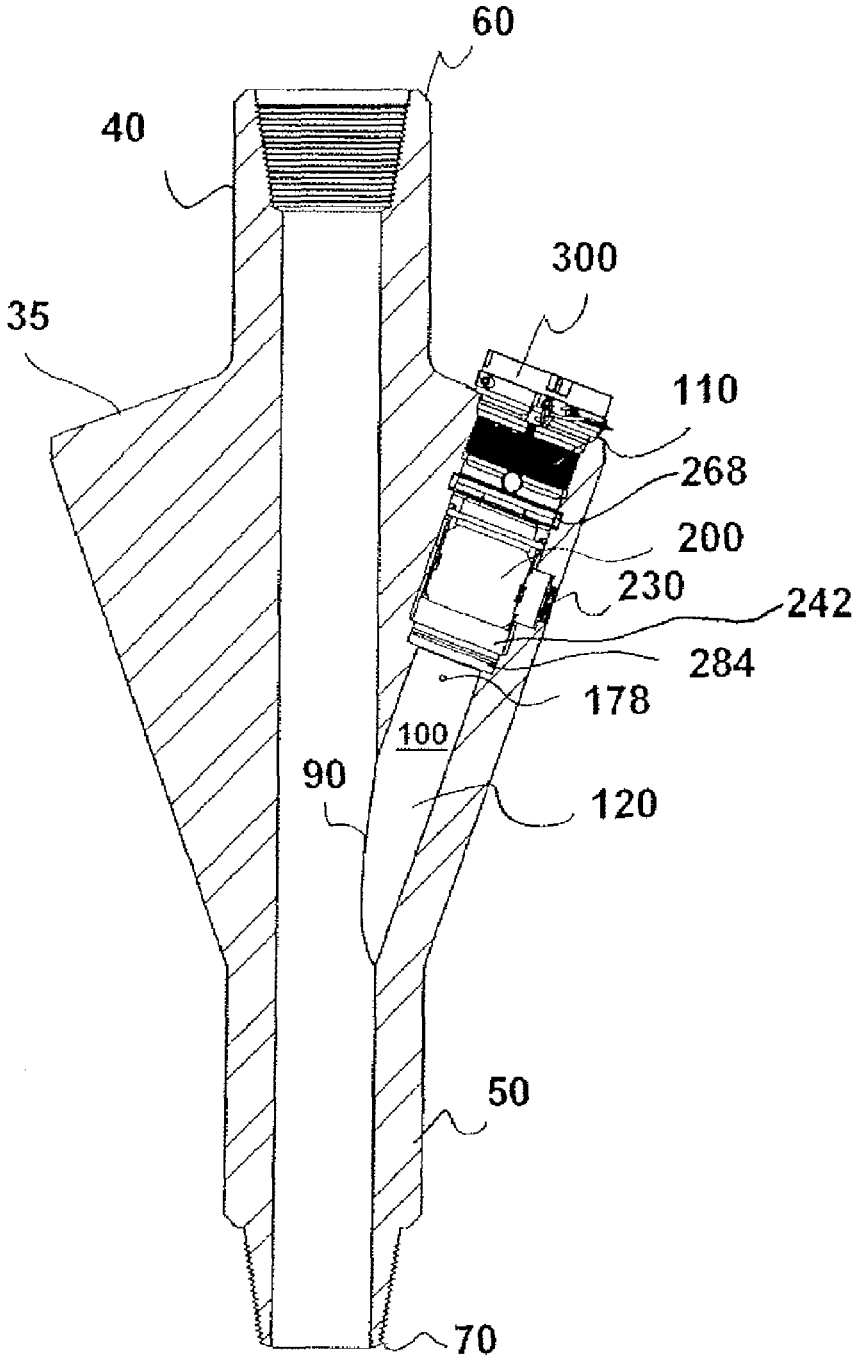
FIGS. 4A and 4B are sectional views taken along line 4-4 of FIG. 3.
Figure 4B:
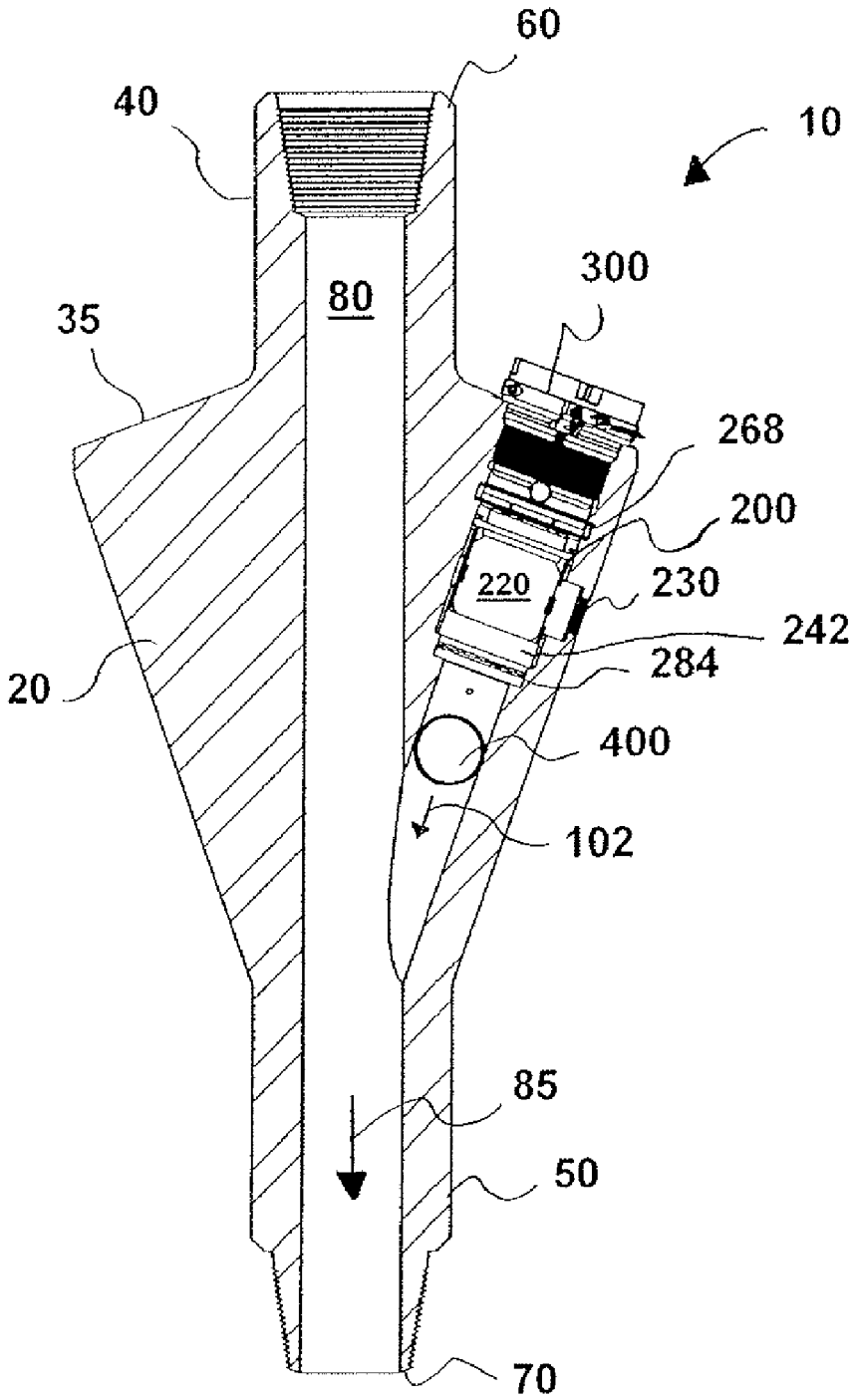
Figure 5:
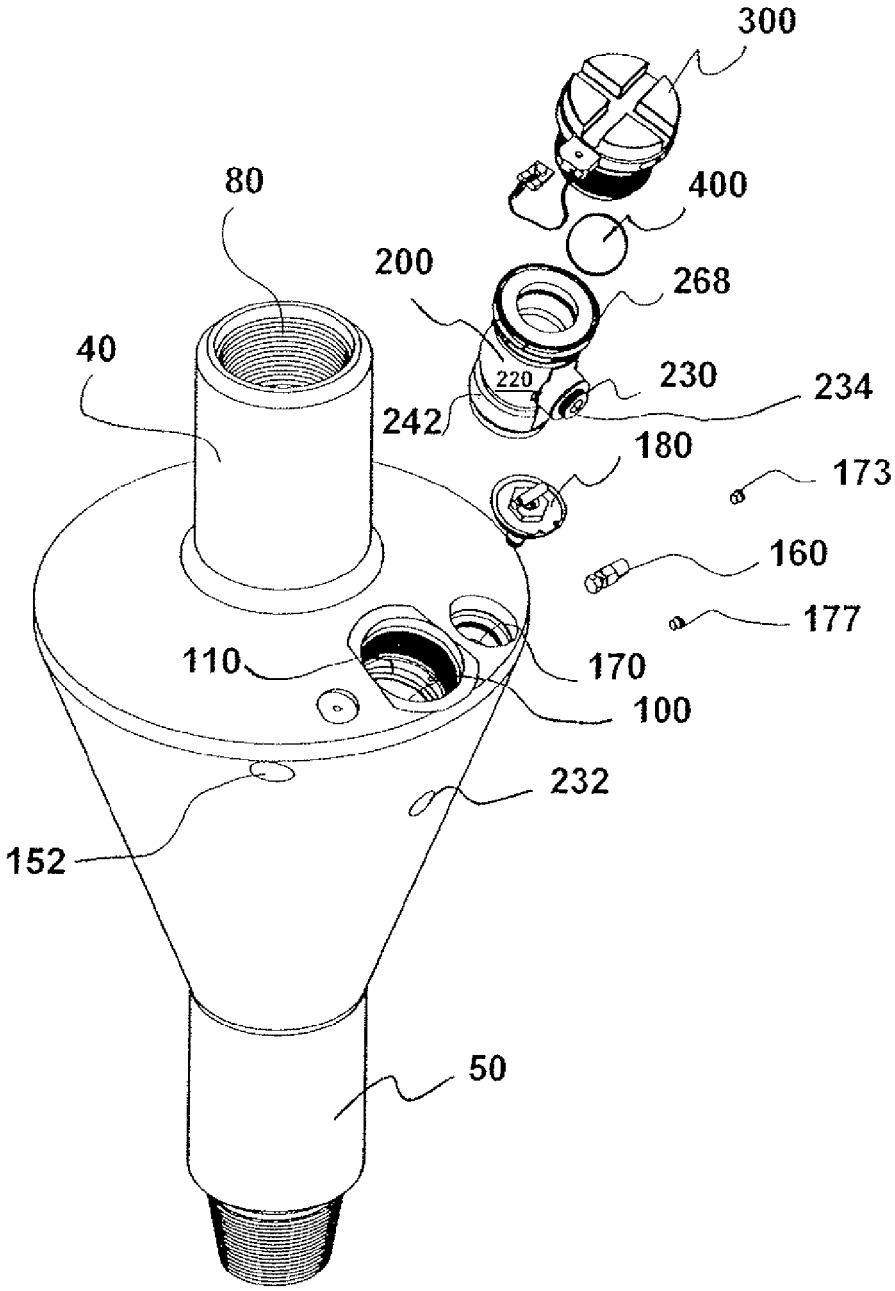
FIG. 5 is an exploded perspective view of various components of the tool of FIG. 1.
Figure 6:
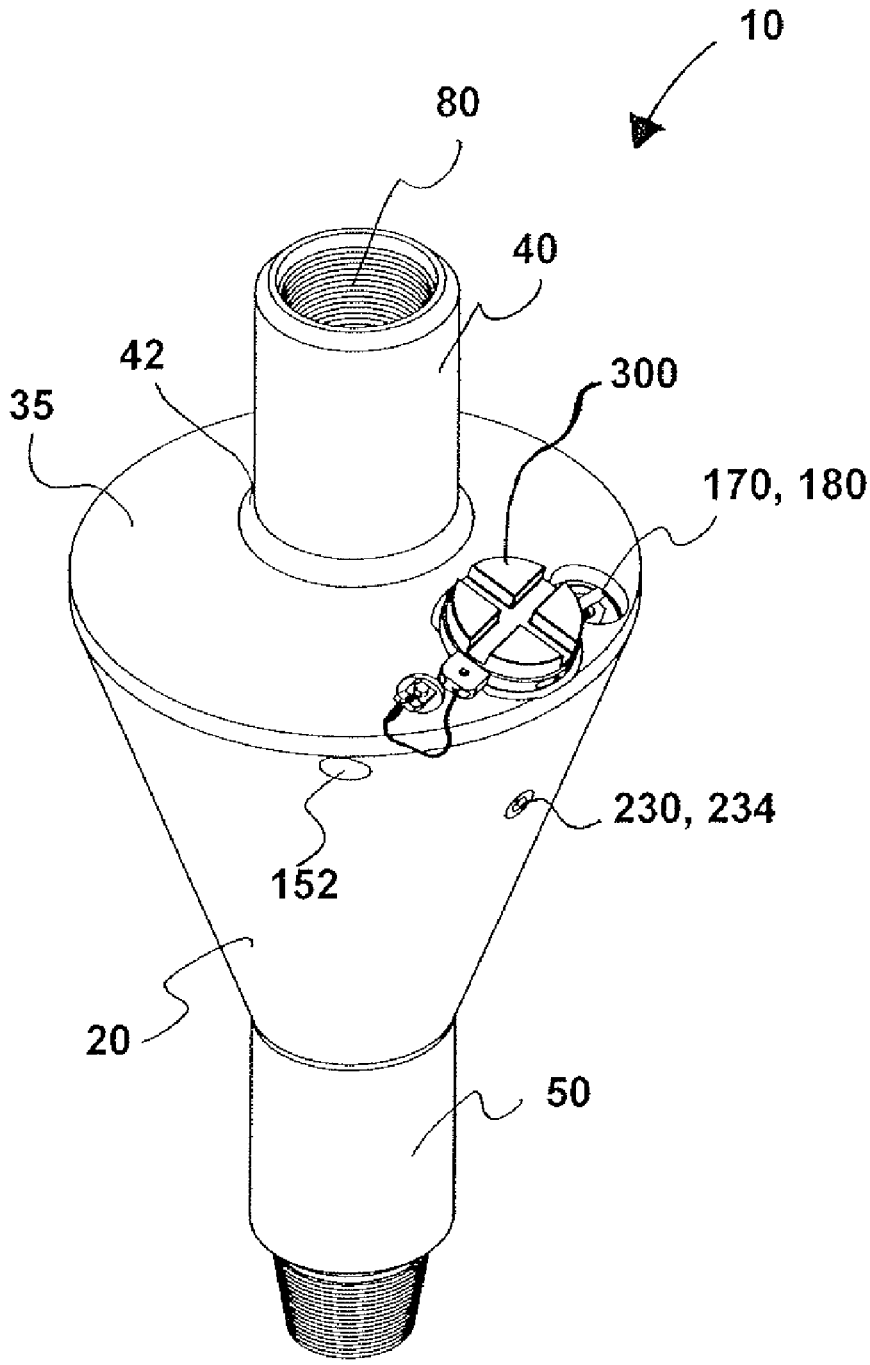
FIG. 6 is a perspective view of the tool of FIG. 1.

FIG. 1 is a front view of a preferred embodiment of tool 10. FIG. 2 is a top view of tool 10. FIG. 3 is a side view of tool 10. FIG. 4 is a sectional view of tool 10 taken along line A-A of FIG. 3. FIG. 5 is an exploded perspective view of various components of tool 10. FIG. 6 is a perspective view of tool 10.

Tool 10 can comprise body 20 which includes enlarged portion 35. Body 20 can include main passage 80 which fluidly connects top 60 to bottom 70. Body 20 can also include second passage 100 which is fluidly connects enlarged portion 35 to main passage 80. Body 20 can be formed from a single forging.

Second passage 100 is preferably angled in relation to main passage 80. Second passage 100 can include upper portion 110 and lower portion 120. Preferably, body 20 is manufactured from a single piece of stock metal (e.g., 4140 steel). Preferably, the range of angles between second passage 100 and main passage 80 is between about 0 and 90 degrees, about 5 and 85 degrees, about 10 and 80 degrees, about 15 and 75 degrees, about 20 and 70 degrees, about 25 and 65 degrees, about 30 and 60 degrees, about 35 and 55 degrees, about 40 and 50 degrees. Additional preferred angles include being about 5, 10, 15, 20, 25, 30, 35, 40, 45, 50, 55, 60, 65, 70, 75, 80, and 85 degrees. In one embodiment second passage can be curved or have varying along its length.

Preferably, second passage 100 is included in enlarged portion 35, reducing the risk that a mechanical failure or leak will occur regarding the fluid connection between main passage 80 and second passage 100.

Upper portion 110 can be sealable in relation to lower portion 120 through seal 198. Seal 198 can be valve 200 (preferably a ball valve) or other sealing means. Valve 200 can be opened and closed through valve operator 230, which can be a valve handle or automatic valve operator. Valve handle can include a connecting portion 234 which can connect to an outside tool, such as a wrench (e.g., an allen wrench). Valve operator 230 can be separable from valve 200.

Figure 9:
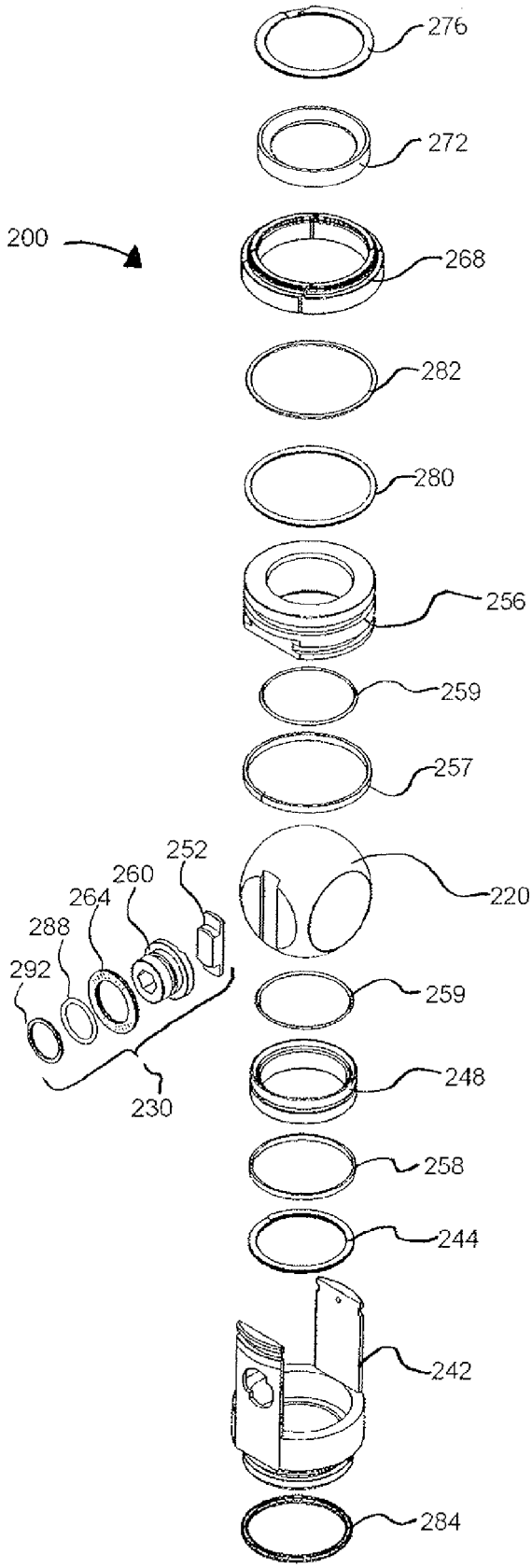
FIG. 9 is an exploded view of a valve which can be used in one embodiment.
Figure 10A:
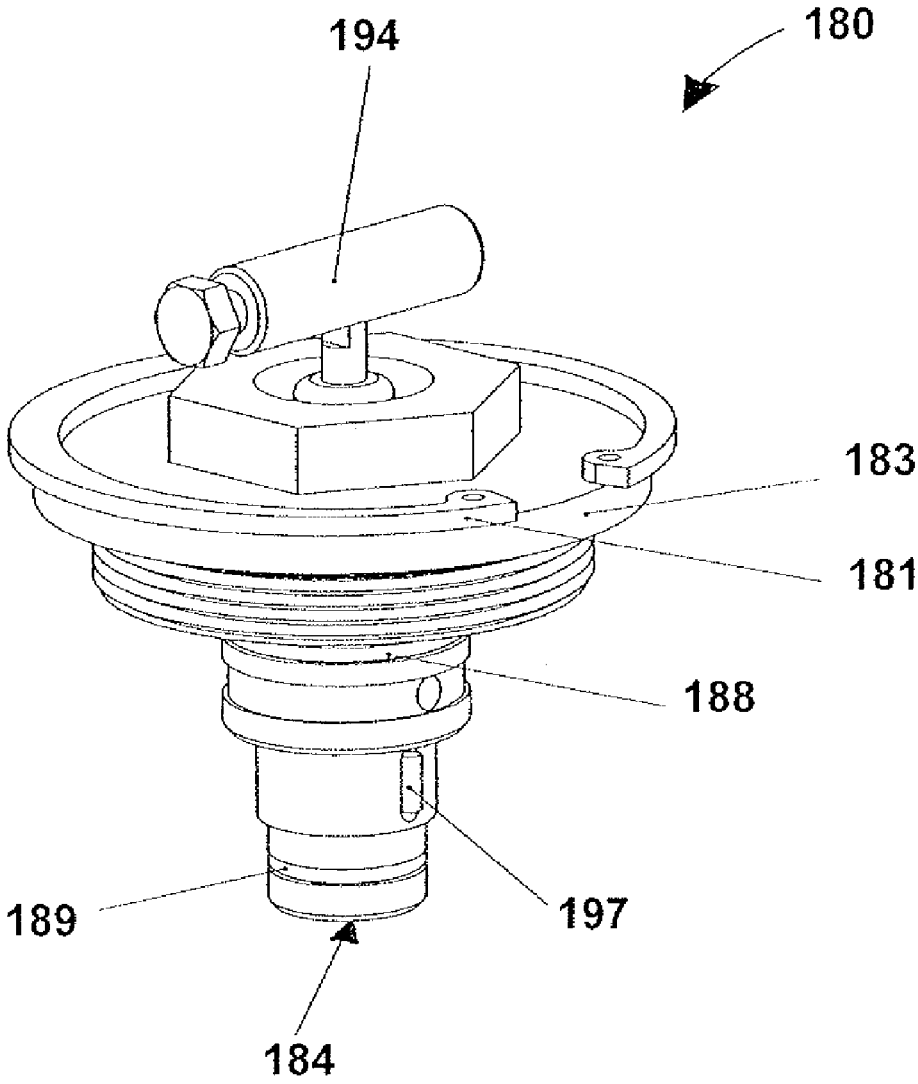
FIGS. 10A and 10B are perspective and side views of one embodiment for an equalizing control where the equalizing control is shown in a closed state.
Figure 10B:
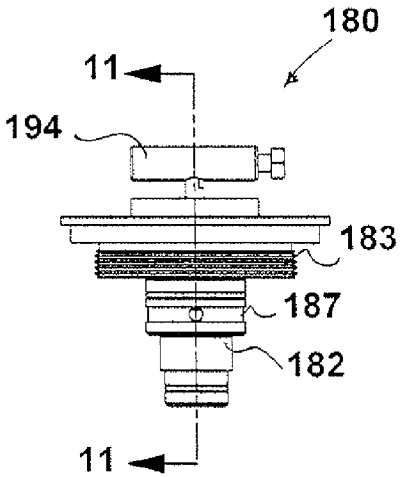
Figure 11A:
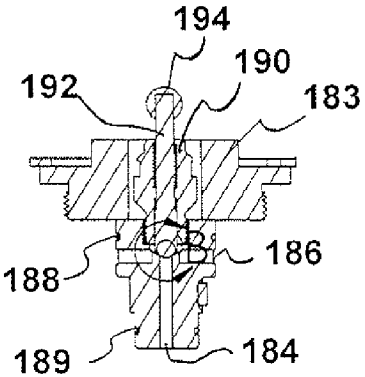
FIGS. 11A and 11B are respectively a sectional view of the equalizing control of FIG. 10B taken along the line 11-11 and an enlarged view of FIG. 11A.
Figure 11B:
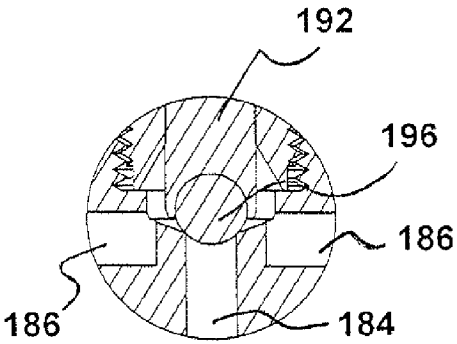
Figure 12:
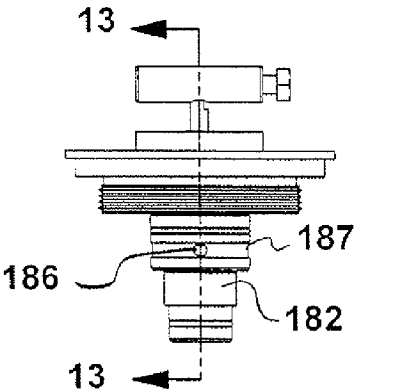
FIG. 12 is the equalizing control of FIG. 110A shown in an open state.
Figure 13A:
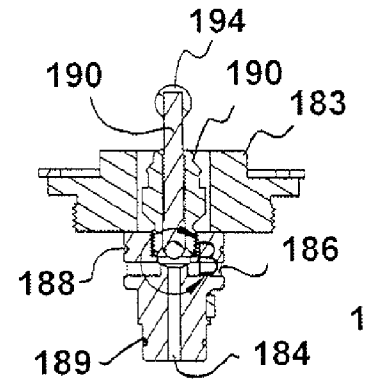
FIGS. 13A and 13B are respectively a sectional view of the equalizing control of FIG. 10A taken along the line 13-13 and an enlarged view of FIG. 13A.
Figure 13B:
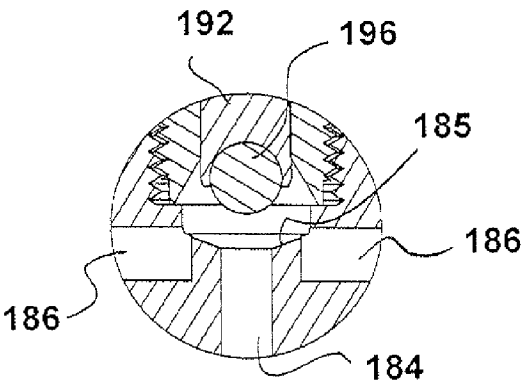

FIG. 9 is an exploded view of one embodiment of valve 200. Valve 200 can comprise cannister 242, valve ball 220, valve operator 230, spring 244, lower seat and teflon 248, upper seat and teflon 256, cage/seat fastener 257, lower seat poly seal 258, upper and lower seat teflon rings 259, locking segment set 268, support ring 272, spiral retainer ring 276, upper seat o-ring 280, upper seat backup ring 282, and cannister o-ring 284. Valve operator 230 can comprise stem 260, stem bearing assembly 264, stem o-ring 288, and stem back up ring 292. Stem 260 can be operatively connected (via sliding) to valve ball 220 through stem link 252 and a slot on valve ball 220. Valve operator 230 can also include connecting portion 234.

To install valve 200 in tool 10, valve operator 230 can be first installed by inserting it through second passage 100 so that operator 230 can be accessible through opening 232. Next, valve 200 can be installed by inserting valve cannister 242 (such as by sliding) through second passage 100 so that valve ball 220 operatively engages operator 230 through a sliding connection. Locking segment set 268 can be used to lock valve 200 in place. Valve 200 can be completely enclosed in second passage 100. Valve 200 can be a commercially available cartridge valve, such as that available from M&M international, P.O. Box 10091, New Iberia, La. 70562 (Telephone number (337)-364-4145). With tool 10 second passage 100 can operate as the housing for the cartridge assembly regarding valve 200.

When closed valve 200 fluidly seals upper portion 110 in relation to lower portion 120. Cap 300 can be used to fluidly seal upper portion 110 in relation to the environment. Valve 200 can include an upper sealing ring 202 (not shown), such as an o-ring or other seal (or even threads). It can also include a lower sealing ring 284, such as an o-ring or other seal (or even threads). Operator 230 can include a sealing ring 280, such as an o-ring or other seal (or even threads). Upper and lower sealing rings 202, 284 along with sealing ring 280 can seal valve 200 relative to second passage 100.

In use tool 10 can be placed in a drill string for an oil and gas well. At bottom 70 of lower body 50 can be threaded using API threading. At top 60 of upper body 40 can also be threaded using API threading. Preferably, a pin end connection is provided at lower body 50 and a box end connection is provided at upper body 40.

In operation (e.g., where tool 10 is connected to a drill string) and it is desired to drop an object (such as ball 400) into the drill string the following procedure can be used. Valve 200 is closed thereby sealing off upper portion 110 from lower portion 120. Vent control 160 can be used to relieve pressure (through vent line 150) in upper portion 110. Cap 300 can be opened and the desired object (e.g., ball 400) placed in upper portion 10 above valve 200. Cap 300 can be placed back sealing off upper portion 110. Vent control 160 can be closed. When desired valve 200 can be opened and the object (e.g., ball 400) will drop in the direction of arrow 102 by action of gravity and/or assisted by a venturi effect of any fluid flow in the direction of arrow 102. When reaching main passage 80 the desired object will continue to drop, but now in the direction of arrow 85.

Figure 7:
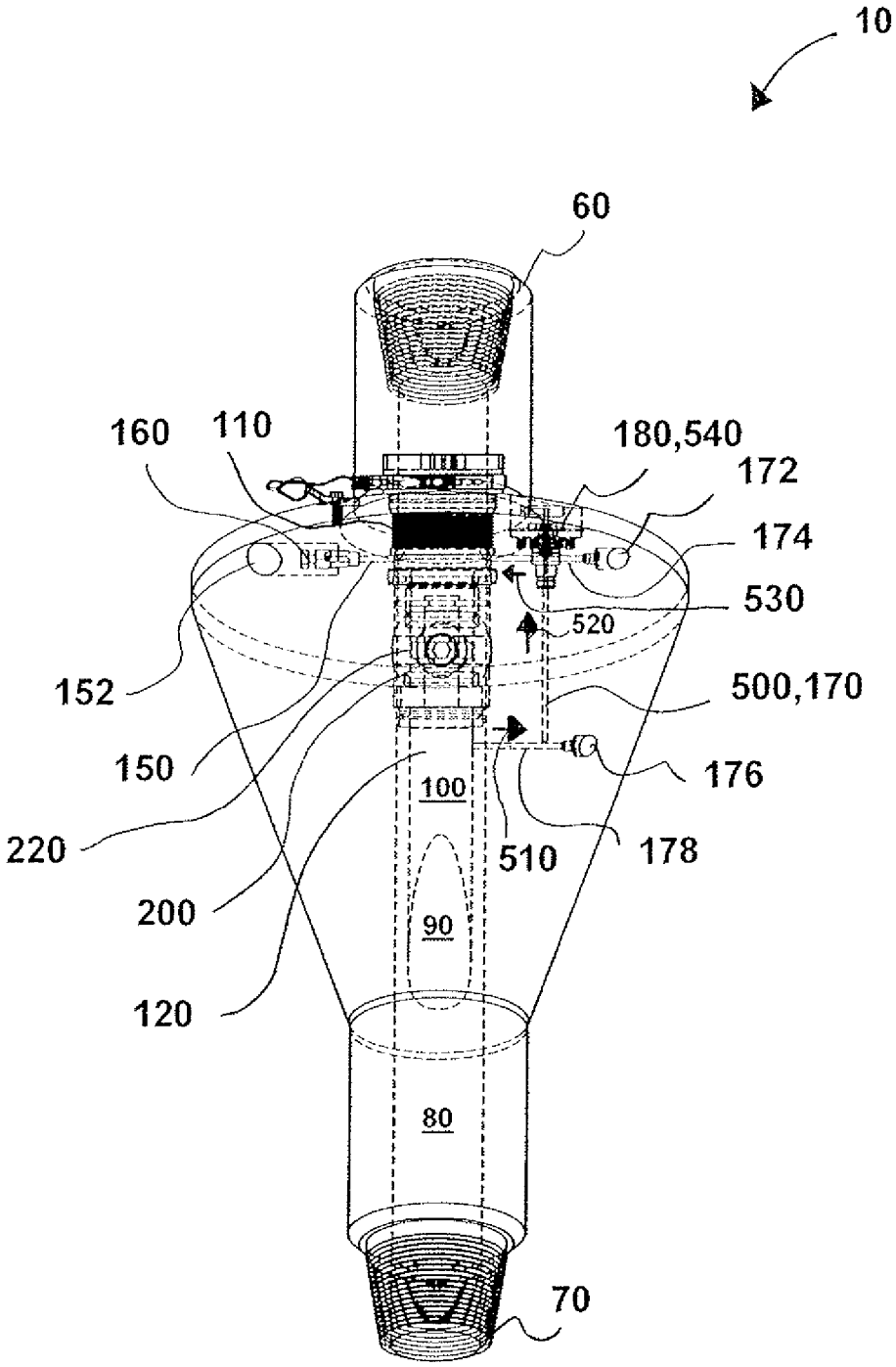
FIG. 7 is a perspective view of the tool of FIG. 1, wherein various items are shown in phantom lines.

Shown in FIG. 7, in an alternative embodiment, a by-pass 500 is provided. By-pass 500 can by-pass seal 198 (e.g., valve 200) and fluidly connect upper portion 110 with lower portion 120 notwithstanding the closed condition of valve 200. Such may be necessary where there exists high pressure in main passage 80. Such high pressure will create a resultant force on the valve ball of valve 200 which may require excessive force to overcome when opening valve 200. Where valve 540 (e.g., equalizing control 180) is opened, fluid can flow from lower portion 120 via by-pass 500 (or equalizing line 170, which can include lower line 178 and upper line 174) in the direction of arrows 510,520, 530 to upper portion 110 until pressure in upper portion 110 is equal to pressure in lower portion 120. Where the pressure is equalized no net resultant force will be found on the valve ball of valve 200 and such valve 200 can be opened easily. Because of machining conditions lower line 178 can be sealed with respect to the outside with plug 177 (via lower opening 176) and upper line 174 can be sealed with respect to the outside with plug 173 (via upper opening 172).

FIGS. 10 through 13 show one embodiment of an equalizing control. Equalizing control 180 can be a needle or plug valve assembly. Equalizing control can comprise cartridge body 182, bonnet 190, valve stem 192, tip 196, and seat 185. Cartridge body 182 can comprise inlet passage 184, seat 185, radial port 186, perimeter recess 187, along with upper and lower o-rings 188, 189. Valve stem 192 can comprise handle 194 and tip 196. Locking nut 183 can be used to hold in place cartridge body 182. Bonnet 190 can be threadably connected to valve stem 192, such that handle 194 can turn stem 192 causing stem 192 to raise or lower depending on the direction of turning of handle 194. Valve stein 192 can include tip 196 which can be a needle or plug type tip. When equalizing control 180 is in a closed state, tip 196 of stein 192 seals with respect to seat 185 and/or inlet passage 184. When equaling control 180 is in an open state, tip 196 is not sealed with respect to seat 185 and/or inlet passage 184. Fluid can flow through inlet passage 184 and into radial port 186, and finally through perimeter recess 187 to move through lines as described in the immediately preceding paragraph.

Figure 14:
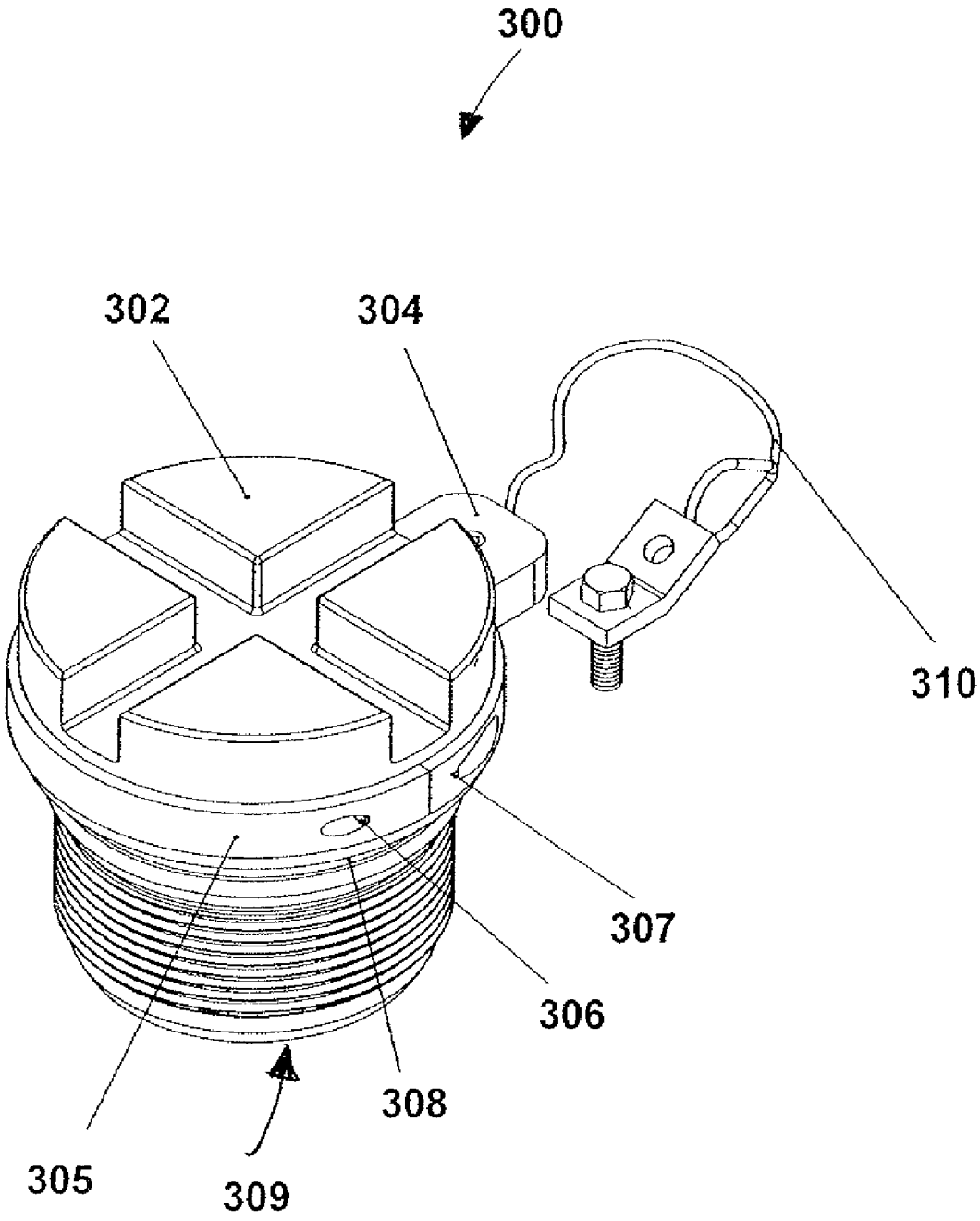
FIG. 14 is a perspective view of a cap for second passageway.

FIG. 14 shows one embodiment of cap 300. Cap 300 can comprise top 302, open area 303 of base of cap (for holding ball 400 or item to be dropped); lanyard tab 304, right retainer 306, left retainer 307, o-ring 308, and lanyard 310.

Figure 8A:
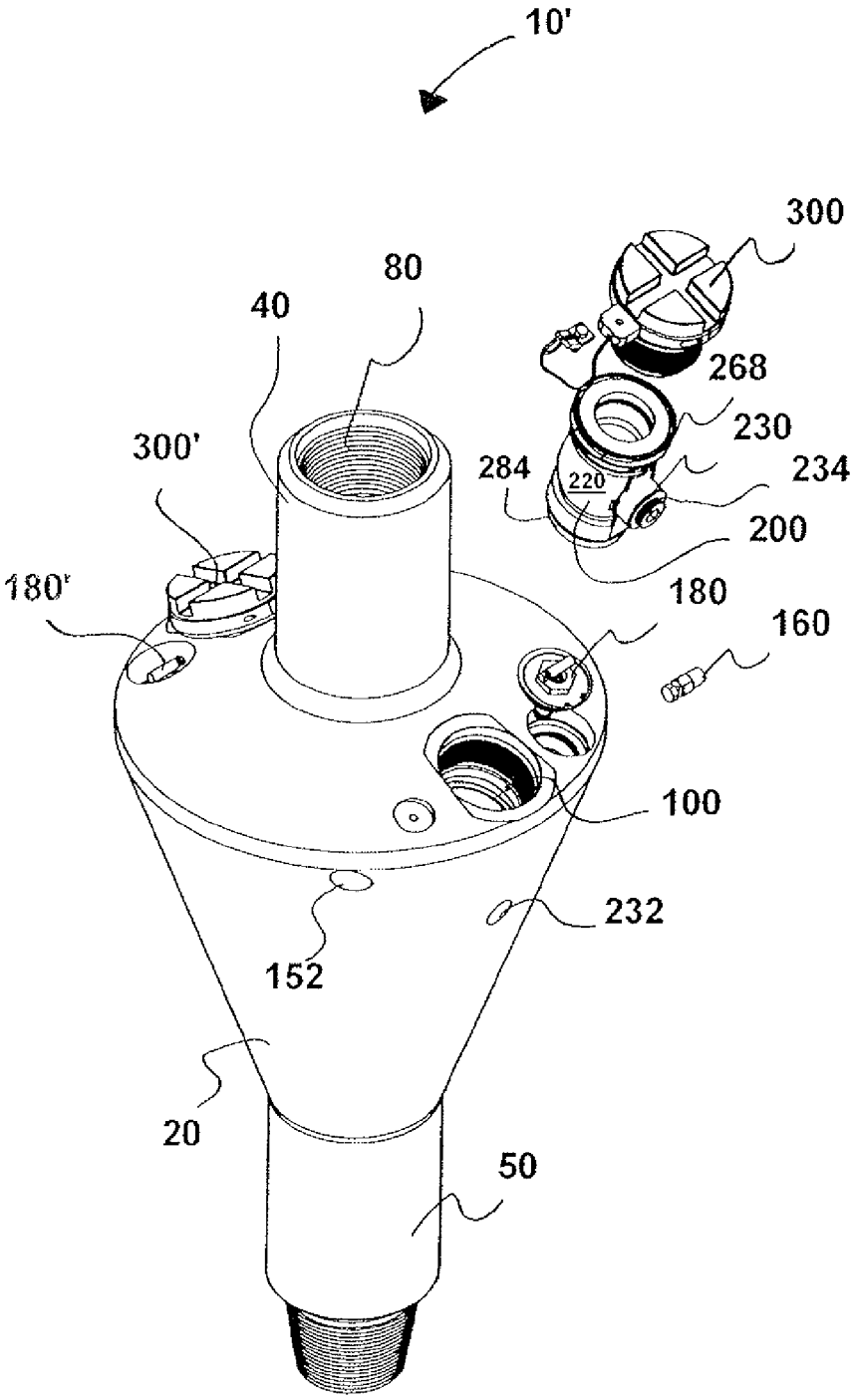
FIG. 8A is an exploded perspective view of an alternative tool having two second passages, which can assist in the quick or simultaneous dropping of multiple objects.
Figure 8B:
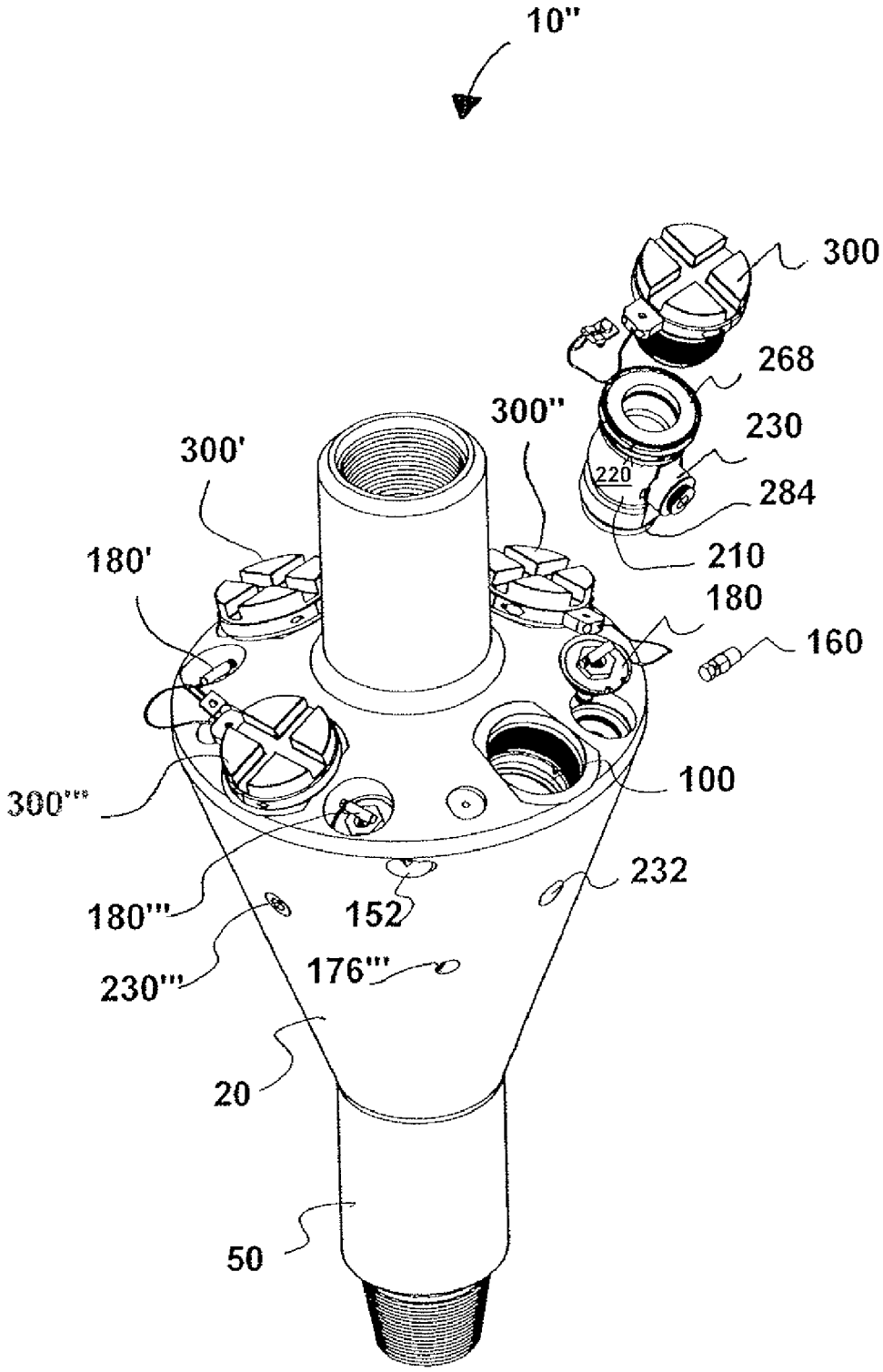
FIG. 8B is an exploded perspective view of another alternative tool having four second passages, which can assist in the quick or simultaneous dropping of multiple objects.

In an alternative embodiment, one or more additional second passages 100', 100", 100'", etc. can be provided in enlarged portion 35 which are also fluidly connected to main passage 80. This can allow multiple dropping activities in a relatively short period of time. FIG. 8A is an exploded perspective view of an alternative tool 10' having multiple second passages (e.g., 100, 100'), which can assist in the quick or simultaneous dropping of multiple objects (e.g., 400, 400'). FIG. 8B is an exploded perspective view of another alternative tool 10" having four second passages (e.g., 100, 100', 100", 100'"), which can assist in the quick or simultaneous dropping of multiple objects (e.g., balls 400, 400', 400", 400'").

In an alternative embodiment, first ball 400 and second ball 400' can have the same or different diameters. In another alternative embodiment, first ball 400, second ball 400', third ball 400", and fourth ball 400'" can have the same or different diameters. Ball sizes are determined by the use of the balls when they are dropped down the tubing or casing string into the well. Depending upon the number of balls it is necessary to drop into the well, the same or different sizes can be used.

OPERATION

Tool 10 can be connected to tubing or casing string. All appropriate piping and hose connections can be made, after which tool 10 is ready for use. Ball 400 may or may not be loaded in tool 10 at the time tool 10 is connected to tubing or casing string. If ball 400 is loaded after tool 10 is connected to tubing or casing string then preferably valve 200 is in a closed state. Valve 200 being in a closed state is necessary when tubing or casing string is pressurized at the time ball 400 is loaded into tool 10. In one embodiment ball 400 can be pre-loaded in tool 10 (i.e., loaded before the time tool 10 is connected to tubing or casing string).

When it is desired to drop a first ball 400 into the well, valve 200 is opened by activating valve operator 230. In one embodiment valve operator 230 can be automatically activated (such as by hydraulic or pneumatic pressure). Activating valve operator 230 will cause valve 200 to enter an open state allowing gravity to pull ball 400 in the direction of arrow 102 (when in second passage 100). When ball 400 enters main passage 80 it will move in the direction of arrow 85. If fluid is flowing in main passage 80 in the direction of arrow 85, then a venturi effect will assist movement of ball 400 in second passage 100 (in the direction of arrow 102). From main passage 80 ball 400 will continue a downward movement in tubing or casing until it eventually contacts a downhole item.

When it is desired to drop second ball 400', valve operator 230 can be deactivated causing it to close valve 200 thereby sealing upper portion 110 of second passage 100. After sealing the upper portion, vent control 160 can be activated to cause vent line 150 to open and release any net gauge pressure from upper portion 110. If no net gauge pressure exists in second passage 100, then second passage 100 does not have to be vented. Once pressure is released from the upper portion 110 of second passage 100, cap 300 can be removed and second ball 400' can be placed in upper portion 10 of second passage 100. Cap 300 can then be connected to upper portion 110 thereby fluidly sealing upper portion 100 from the outside. Vent line 150 should be checked to make sure it is closed. At this point to drop second ball 400' the same steps as described in the immediately preceding paragraph should be followed.

Although a hydraulic or pneumatic remote control actuation of valve 200 has been described, other means of activation can be used. For example, but not by way of limitation, manually activated valve 200 can be performed when desired using a driver or valve 200 can be rotated by a screw driven by an electric motor.

The following is a list of reference numerals:

LIST FOR REFERENCE NUMERALS

| (Reference No.) | (Description) |
|---|---|
| 10 | tool |
| 20 | body |
| 30 | main body |
| 35 | enlarged section |
| 40 | upper body |
| 42 | rounded portion |
| 50 | lower body |
| 60 | top |
| 70 | bottom |
| 80 | main passage |
| 85 | arrow |
| 90 | connection between main and second passage |
| 100 | second passage |
| 102 | arrow |
| 110 | upper portion |
| 120 | lower portion |
| 150 | vent line |
| 152 | vent opening |
| 160 | vent control |
| 170 | equalizing line |
| 172 | upper opening |
| 173 | plug |
| 174 | upper line |
| 176 | lower opening |
| 177 | plug |
| 178 | lower line |
| 180 | equalizing control |
| 181 | snap ring |
| 182 | cartridge body |
| 183 | locking nut |
| 184 | inlet passage |
| 185 | seat |
| 186 | radial port |
| 187 | perimeter recess |
| 188 | upper o-ring |
| 189 | lower o-ring |
| 190 | bonnet |
| 192 | valve stem |
| 194 | handle |
| 196 | tip |
| 197 | pin |
| 198 | seal |
| 200 | valve |
| 202 | upper sealing ring |
| 220 | valve ball |
| 230 | valve operator |
| 232 | opening |
| 234 | connecting portion |
| 242 | cage or cannister |
| 244 | spring |
| 248 | lower seat and teflon |
| 252 | stem link |
| 256 | upper seat and teflon |
| 257 | cage/seat fastener |
| 258 | lower seat poly seal |
| 259 | upper and lower seat teflon ring |
| 260 | stem |
| 264 | stem bearing assembly |
| 268 | locking segment set |
| 272 | support ring |
| 276 | spiral retainer ring |
| 280 | upper seat o-ring |

-continued

LIST FOR REFERENCE NUMERALS

| (Reference No.) | (Description) |
|---|---|
| 282 | upper seat backup ring |
| 284 | cannister o-ring |
| 288 | stem o-ring |
| 292 | stem back up ring |
| 300 | cap |
| 302 | top |
| 303 | open area of base of cap (for holding ball or item to be dropped). |
| 304 | lanyard tab |
| 306 | right retainer |
| 307 | left retainer |
| 308 | o-ring |
| 310 | lanyard |
| 400 | ball |
| 500 | by-pass passage |
| 510 | arrow |
| 520 | arrow |
| 530 | arrow |
| 540 | valve |

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

What is claimed is:

1. A side drop tool for launching items into a well conduit comprising:

(a) a main body section having upper and lower portions;

(b) a main passage through the main body section extending from the upper portion to the lower portion;

(c) a side drop passage which intercepts the main passage;

(d) a seal operatively connected to the side drop passage, separating the side drop passage into upper and lower portions, and having open and closed states, and when the seal is in the closed state, the upper portion of the side drop passage being fluidly sealed from the main passage; and (e) a cap connected to the upper portion of the side drop passage.

2. The side drop tool of claim 1, wherein the seal is a valve.

3. The side drop tool of claim 2, wherein the valve is a ball valve.

4. The side drop tool of claim 1, further comprising a vent fluidly connected to the upper portion of the side drop passage.

5. The side drop tool of claim 4, wherein the fluid connection includes a valve.

6. The side drop tool of claim 1, wherein the main body section includes an enlarged portion and the side drop passage is contained within the main body section.

7. The side drop tool of claim 6, wherein the enlarged portion has a frustoconical shape.

8. The side drop tool of claim 1, further comprising a by-pass allowing equalization of pressure in both the upper and lower portions of the side drop passage when the seal is the closed state.

9. The side drop tool of claim 1, further comprising a ball to be dropped, the ball being located in the side drop passage.

10. The side drop tool of claim 1, wherein the cap fluidly seals the upper portion of the side drop passage.

11. The side drop tool of claim 1, wherein the cap is a plug.

12. The side drop tool of claim 11, wherein the plug is threaded.

13. The side drop tool of claim 11, wherein the plug is flush with the top of the upper portion of the side drop passage.

14. The side drop tool of claim 1, wherein the side drop passage is at a 20 degree angle in relation to the main passage.

15. The side drop tool of claim 1, wherein a plurality of side drop passages are included each of which is fluidly connected to the main passage.

16. A side drop tool for launching items into a well conduit comprising:

(a) a main body section having upper and lower portions;

(b) a main passage, the main passage being a single bore through the main body section from the upper portion to the lower portion;

(c) a side drop passage which intercepts the main passage;

(d) wherein the main body section includes an enlarged portion and the side drop passage is contained within the main body section; and (e) a cap connected to the side drop passage, wherein the side drop passage includes a seal separating the side drop passage into upper and lower portions, and having open and closed states.

17. The side drop tool of claim 16, wherein the seal is a valve.

18. The side drop tool of claim 17, wherein the valve is a ball valve.

19. The side drop tool of claim 16, further comprising a by-pass allowing equalization of pressure in both the upper and lower portions of the side drop passage when he seal is the closed state.

20. The side drop tool of claim 16, further comprising a ball to be dropped, the ball being located in the side drop passage.

21. The side drop tool of claim 16, wherein the cap fluidly seals the upper portion of the side drop passage.

22. The side drop tool of claim 16, wherein the cap is a plug.

23. The side drop tool of claim 22, wherein the plug is threaded.

24. The side drop tool of claim 16, wherein a plurality of side drop passages are included each of which is fluidly connected to the main passage.

25. A side drop tool for launching items into a well conduit comprising:

(a) a main body section having upper and lower portions;

(b) a main passage, the main passage being a single bore through the main body section from the upper portion to the lower portion;

(c) a side drop passage which intercepts the main passage;

(d) wherein the main body section includes an enlarged portion and the side drop passage is contained within the main body section; and (e) a cap connected to the side drop passage, wherein the side drop passage has upper and lower portions, further comprising a vent fluidly connected to the upper portion of the side drop passage.

26. The side drop tool of claim 25, wherein the fluid connection includes a valve.

27. A side drop tool for launching items into a well conduit comprising:

(a) a main body section having upper and lower portions;

(b) a main passage, the main passage being a single bore through the main body section from the upper portion to the lower portion;

(c) a side drop passage which intercepts the main passage;

(d) wherein the main body section includes an enlarged portion and the side drop passage is contained within the main body section; and (e) a cap connected to the side drop passage, wherein the enlarged portion has a frustu-conical shape.

28. A side drop tool for launching items into a well conduit comprising:

(a) a main body section having upper and lower portions;

(b) a main passage, the main passage being a single bore through the main body section from the upper portion to the lower portion;

(c) a side drop passage which intercepts the main passage;

(d) wherein the main body section includes an enlarged portion and the side drop passage is contained within the main body section; and (e) a cap connected to the side drop passage, wherein the side drop passage has upper and lower portions, and wherein the cap is a plug and the plug is flush with the top of the upper portion of the side drop passage.

29. A side drop tool for launching items into a well conduit comprising:

(a) a main body section having upper and lower portions;

(b) a main passage, the main passage being a single bore through the main body section from the upper portion to the lower portion;

(c) a side drop passage which intercepts the main passage;

(d) wherein the main body section includes an enlarged portion and the side drop passage is contained within the main body section; and (e) a cap connected to the side drop passage, wherein the side drop passage is at a 20 degree angle in relation to the main passage.

30. A method of dropping an item in a well, the method comprising the steps of:

(a) positioning a ball drop apparatus above the well, the apparatus comprising a main body section having upper and lower portions; a main passage through the main body section extending from the upper portion to the lower portion; a side drop passage which intercepts the main passage; a seal operatively connected to the side drop passage, separating the side drop passage into upper and lower portions, and having open and closed states, and when the seal is in the closed state, the upper portion of the side drop passage being fluidly sealed from the main passage;

(b) inserting an item into the upper portion of the side drop passage;

(c) opening the seal thereby allowing the item to drop through the side drop passage and into the well.

31. The method of claim 30, comprising the further step of closing the seal.

32. The method of claim 31, wherein after step "c", the seal is closed and a second item is inserted into the upper portion of the side drop passage.

33. The method of claim 31, wherein in step "a" the seal includes a valve and the valve is inserted into the side drop passage, wherein the valve includes a control to open and close the valve, and the control being accessible outside of the side drop passage.

34. The method of claim 31, wherein in step "a" the ball drop apparatus includes a vent, the vent allowing venting of the side drop passage.

35. The method of claim 32, wherein after placing the second item, the seal is opened a second time thereby allowing the second item to drop through the side drop passage and into the well.

36. The method of claim 30, comprising the further step of placing a cap to seal the upper portion of the side drop passage.

* * * * *